US006202956B1

(12) United States Patent
Grasso et al.

(10) Patent No.: US 6,202,956 B1
(45) **Date of Patent: *Mar. 20, 2001**

(54) DISPENSER FOR DISPENSING TOILET TISSUE FROM ROLLS

(75) Inventors: Kamala J. Grasso, Wayland; Jason E. Short, Cambridge, both of MA (US); Robert Mervar, Hillsboro, OR (US); John R. Moody, Neenah; Douglas W. Johnson, Appleton, both of WI (US); Peter D. Johnson, Aroura, IL (US)

(73) Assignee: Fort James Corporation, Deerfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/262,355

(22) Filed: Mar. 4, 1999

Related U.S. Application Data

(63) Continuation-in-part of application No. 09/118,547, filed on Jul. 17, 1998, now abandoned, which is a continuation of application No. 08/728,208, filed on Oct. 10, 1996, now Pat. No. 5,813,624.

(51) Int. Cl.[7] ..... B65H 19/00; B65H 16/04

(52) U.S. Cl. ..... 242/560; 242/597.6; 242/597.8; D6/523

(58) Field of Search ..... 242/560, 597.8, 242/597.5, 597.6; 312/34.22, 34.8, 34.19, 34.21, 34.23; D6/523, 522

(56) References Cited

U.S. PATENT DOCUMENTS

| | | | |
|---|---|---|---|
| 1,885,192 | 11/1932 | Elssner et al. . | |
| 2,487,763 | 11/1949 | Patterson et al. . | |
| 3,010,670 | 11/1961 | Jones et al. . | |
| 3,184,176 | 5/1965 | Tucker et al. . | |
| 3,211,504 | 10/1965 | Bump . | |
| 3,294,329 | 12/1966 | Tucker et al. . | |
| 3,381,909 | 5/1968 | Tucker et al. . | |
| 3,418,029 | 12/1968 | Wooster . | |
| 3,420,465 | 1/1969 | Brunner et al. . | |
| 3,637,276 | 1/1972 | Bump . | |
| 3,656,699 | 4/1972 | Schnyder et al. . | |
| 4,375,874 | 3/1983 | Leotts et al. . | |
| 4,998,681 | 3/1991 | McNeill . | |
| 5,265,816 | 11/1993 | Collins . | |
| 5,323,980 | 6/1994 | Neveu et al. . | |
| 5,813,624 * | 9/1998 | Grasso et al. | 242/560 |

* cited by examiner

*Primary Examiner*—John Q. Nguyen
(74) *Attorney, Agent, or Firm*—Burns, Doane, Swecker & Mathis, L.L.P.

(57) ABSTRACT

A dispenser for dispensing toilet tissue alternately from two rolls includes a housing and roll support spindles for supporting the rolls in coaxial spaced relationship relative to the housing. A sliding cover is slidably positioned on the housing. The roll support spindles are mounted on a pivoted support frame and a pivotally mounted engaging member extends from the support frame and is located in the space between adjacent roll ends. The cover includes detents which cooperate with the pivotally mounted tissue roll engaging member to prevent the cover from being moved from one position in which one of the tissue rolls is exposed to a second position in which the other tissue roll is exposed until the one tissue roll is depleted or substantially depleted.

22 Claims, 12 Drawing Sheets

DISPENSER FOR DISPENSING TOILET TISSUE FROM ROLLS

This application is a continuation-in-part application of application Ser. No. 09/118,547 filed on Jul. 17, 1998, abandoned which is a continuation of application Ser. No. 08/728,208 filed on Oct. 10, 1996 (now U.S. Pat. No. 5,813,624), the entire content of both of which is incorporated herein by reference, and both of which serve as the basis for a claim for priority under 35 U.S.C. §120 in this application.

FIELD OF THE INVENTION

This invention generally relates to a tissue dispenser apparatus. More particularly, the present invention pertains to a dispenser for dispensing toilet tissue from two rolls on an alternate basis.

BACKGROUND OF THE INVENTION

It is known to employ dispensers holding two or more rolls of toilet tissue or similar sheet material which maintain at least one of the rolls as a reserve roll while the toilet tissue is being dispensed from the other roll. Such devices are usually, but not exclusively, employed in institutional environments such as public rest rooms.

The following United States patents disclose various dispensers of this type: U.S. Pat. No. 3,010,670, issued Nov. 28, 1961, U.S. Pat. No. 5,265,816, issued Nov. 30, 1993, U.S. Pat. No. 3,656,699, issued Apr. 18, 1972, U.S. Pat. No. 3,211,504, issued Oct. 12, 1965, U.S. Pat. No. 3,294,329, issued Dec. 27, 1966, U.S. Pat. No. 4,998,681, issued Mar. 12, 1991, U.S. Pat. No. 4,375,874, issued Mar. 8, 1983, U.S. Pat. No. 3,637,276, issued Jan. 25, 1972, U.S. Pat. No. 3,381,909, issued May 7, 1968, and U.S. Pat. No. 2,487,763, issued Nov. 8, 1949.

The present invention is characterized by its relative simplicity, reliability, and low manufacturing cost as compared to other dispensers which, for example, can employ relatively complicated structures, including springs, to control access to two or more rolls from which sheet material is to be dispensed. Furthermore, many prior dispensers cannot be utilized to dispense from rolls without cores, i.e. coreless rolls. The apparatus disclosed and claimed herein, on the other hand, is suitable for such purpose. The subject invention also incorporates structure which facilitates roll replenishment, as compared to some dispensing systems which may require considerable time, effort, and experience to accomplish such end.

SUMMARY OF THE INVENTION

According to one aspect of the invention, a dispenser for dispensing tissue paper includes a housing having first and second housing members, with the second housing member being movable relative to the first housing member between an open position for accessing the housing interior and a closed position, and a roll support mechanism including first and second roll support spindles for supporting first and second rolls of toilet tissue in a coaxial relationship, with the first roll of toilet tissue located adjacent to one of the ends of the housing, the second roll of toilet tissue located adjacent to the other end of the housing, and adjacent ends of the rolls of toilet tissue defining a space therebetween. Each roll support spindle includes a support shaft and a sleeve rotatably disposed about the support shaft for insertion into a toilet tissue roll. The dispenser also includes a cover slidably positioned on the second housing member and selectively slidably movable relative to the housing between a first cover location wherein the first roll of toilet tissue is exposed for manual access and the second roll of toilet tissue is not exposed for manual access and a second cover location wherein the second roll of toilet tissue is exposed for manual access and the first roll of toilet tissue is not exposed for manual access. A locking mechanism is provided for locking the cover against slidable movement relative to the housing between the first and second cover locations until substantial depletion of one of the rolls of toilet tissue which is exposed for being dispensed. The locking mechanism includes a toilet tissue roll end engagement member pivotally mounted on the roll support mechanism at a location between the first and second roll support spindles, dependent from the roll support mechanism, and positioned in the space defined by the adjacent ends of toilet tissue rolls supported by the roll support mechanism, and detents on the cover which are engageable with the toilet tissue roll end engagement member.

Another aspect of the invention involves a dispenser for dispensing tissue paper includes a housing having first and second housing members, with the second housing member being movable relative to the first housing member between an open position for accessing the housing interior and a closed position, a support frame mounted within the housing interior, and first and second roll support spindles mounted on the support frame and extending in opposite directions from the support frame for supporting respective rolls of toilet tissue so that a space exists between facing ends of the rolls of toilet tissue. A cover is slidably mounted in the opening in the second housing member and is selectively slidably movable relative to the second housing member between a first cover location in which the roll of toilet tissue supported on the first roll support spindle is exposed for manual access and the roll of toilet tissue supported on the second roll support spindle is covered to prevent manual access, and a second cover location in which the roll of toilet tissue supported on the second roll support spindle is exposed for manual access and the roll of toilet tissue supported on the first roll support spindle is covered to prevent manual access. The cover has at least one detent, and a toilet tissue roll end engagement member is pivotally mounted on and extends from the support frame to be positioned in the space between the facing ends of the toilet tissue rolls. The toilet tissue roll end engagement member includes a first leg and a second leg, with the second leg extending transversely from the first leg and with the toilet tissue roll end engagement member being engaged by the detent on the cover when the cover is urged from the first cover location towards the second cover location. The second leg is adapted to engage the facing end of the tissue roll supported on the second roll support spindle when the cover is urged from the first cover location towards the second cover location prior to substantial depletion of the roll of toilet tissue supported on the second roll support spindle to thereby prevent the cover from being moved to the second cover location.

According to another aspect of the invention, a dispenser for dispensing tissue paper includes a housing having first and second housing members, with the second housing member being movable relative to the first housing member between an open position for accessing the housing interior and a closed position. The second housing member is provided with an opening bounded by an upper edge, a lower edge and a pair of side edges, and possesses an inner side facing towards the housing interior when the second housing member is in the closed position. The second housing member includes a rib located at the inner side of the second housing member, with the rib being positioned above the upper edge of the opening and extending between opposite ends of the second housing member. A support frame is mounted within the housing interior, and first and second roll support spindles are mounted on the support frame and extend in opposite directions from the support frame for supporting respective rolls of toilet tissue. A cover is slidably mounted within the opening in the second housing member and is selectively slidably movable relative to the second housing member between a first cover location in which the roll of toilet tissue supported on the first roll support spindle is exposed for manual access and the roll of toilet tissue supported on the second roll support spindle is covered to prevent manual access, and a second cover location in which the roll of toilet tissue supported on the second roll support spindle is exposed for manual access and the roll of toilet tissue supported on the first roll support spindle is covered to prevent manual access. The cover has an upper side and opposite ends, and includes one or more housing engaging members located at the upper side of the cover and at the opposite ends of the cover. Each housing engaging member is provided with a slot that receives the rib on the inner side of the second housing member.

A further aspect of the invention involves a dispenser for dispensing tissue paper includes a housing having first and second housing members, with the second housing member being movable relative to the first housing member between an open position for accessing the housing interior and a closed position, and with the second housing member being provided with an opening bounded by an upper edge, a lower edge and a pair of side edges. The second housing possesses an interior surface facing towards the housing interior when the second housing member is in a closed position, and includes a reinforcement member. The reinforcement member has opposite ends fixed to the interior surface of the second housing member and an intermediate portion spaced from the interior surface of the second housing member to define a through slot located below the opening in the second housing member, The second housing member also includes a fixing element that fixes a part of the intermediate portion of the reinforcing member to the interior surface of the second housing member. A support frame is mounted within the housing interior, and first and second roll support spindles are mounted on the support frame and extend in opposite directions from the support frame for supporting respective rolls of toilet tissue. A cover is slidably mounted within the opening in the second housing member and is selectively slidably movable relative to the second housing member between a first cover location in which the roll of toilet tissue supported on the first roll support spindle is exposed for manual access and the roll of toilet tissue supported on the second roll support spindle is covered to prevent manual access, and a second cover location in which the roll of toilet tissue supported on the second roll support spindle is exposed for manual access and the roll of toilet tissue supported on the first roll support spindle is covered to prevent manual access. The cover has a lower side from which extends a projecting engaging element extending into the through slot.

BRIEF DESCRIPTION OF DRAWING FIGURES

Additional details and features associated with the present invention will become apparent from the following detailed description considered with reference to the accompanying drawing figures in which like elements are designated with like reference numerals and wherein.

DETAILED DESCRIPTION OF THE INVENTION

Figure 1:
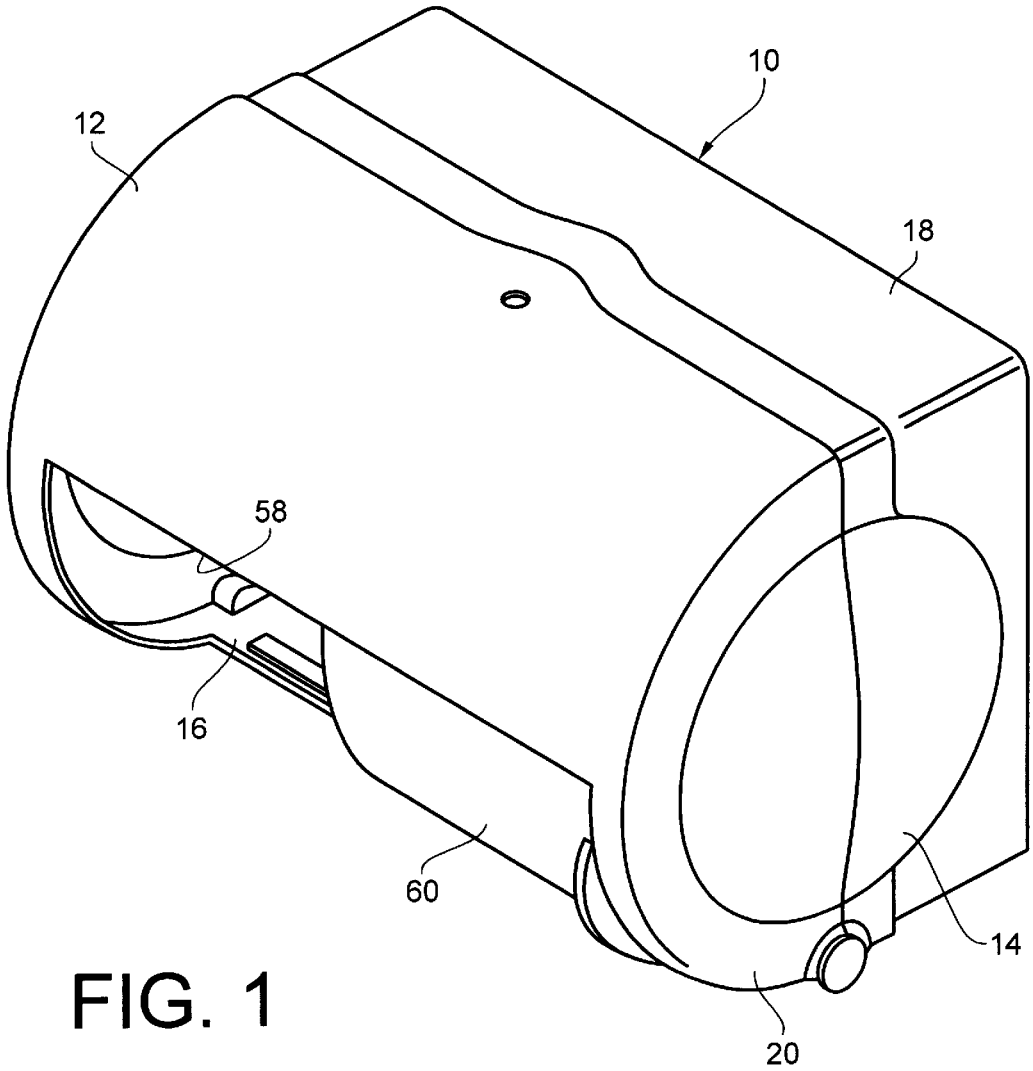
FIG. 1 is a perspective view of apparatus constructed in accordance with the teachings of the present invention with the first and second housing members thereof secured together in dispensing condition.

Referring to FIGS. 1 through 6A, the dispenser apparatus constructed in accordance with the present invention includes a housing 10 having ends 12, 14 and defining a housing interior 16. The housing 10 includes a first housing member 18 for attachment to a wall or other support surface and a second housing member 20 which is pivotally connected to the first housing member 18 and movable between the closed position shown in FIG. 1 and the open position shown in FIG. 2. Pivotal movement takes place about a pivot rod 22 to which the housing members 18, 20 are connected. A latch 24 of any suitable type is utilized to latch the housing members closed during dispensing of toilet tissue from the dispenser apparatus therefrom.

Also pivotally mounted on the pivot rod 22 is a roll support mechanism that includes a support frame 30 having axially aligned roll support spindles 32, 34 projecting outwardly from the support frame and away from each other. The support frame 30 defines an opening 36 therein.

The support frame 30 includes a bifurcated projection 38 from which depends a toilet tissue roll end engagement member 40 in the form of a flat plate which is freely pivotally mounted on the projection. Gravity will urge the toilet tissue roll end engagement member or plate 40 to the vertical condition (shown in FIG. 4, for example), if no outside forces are applied to the toilet tissue roll end engagement member or plate 40. The toilet tissue roll end engagement member 40 is pivotally mounted on the support frame 30 at a location between the roll support spindles 32, 34, with the member or plate 40 positioned in the space defined between adjacent ends of the toilet tissue rolls supported by the roll support spindles 32, 34. A rib 39 projects from second housing member 20 and is received by the bifurcated projection 38 when the second housing member 20 is closed to add structural stability to the dispenser.

Figure 2:
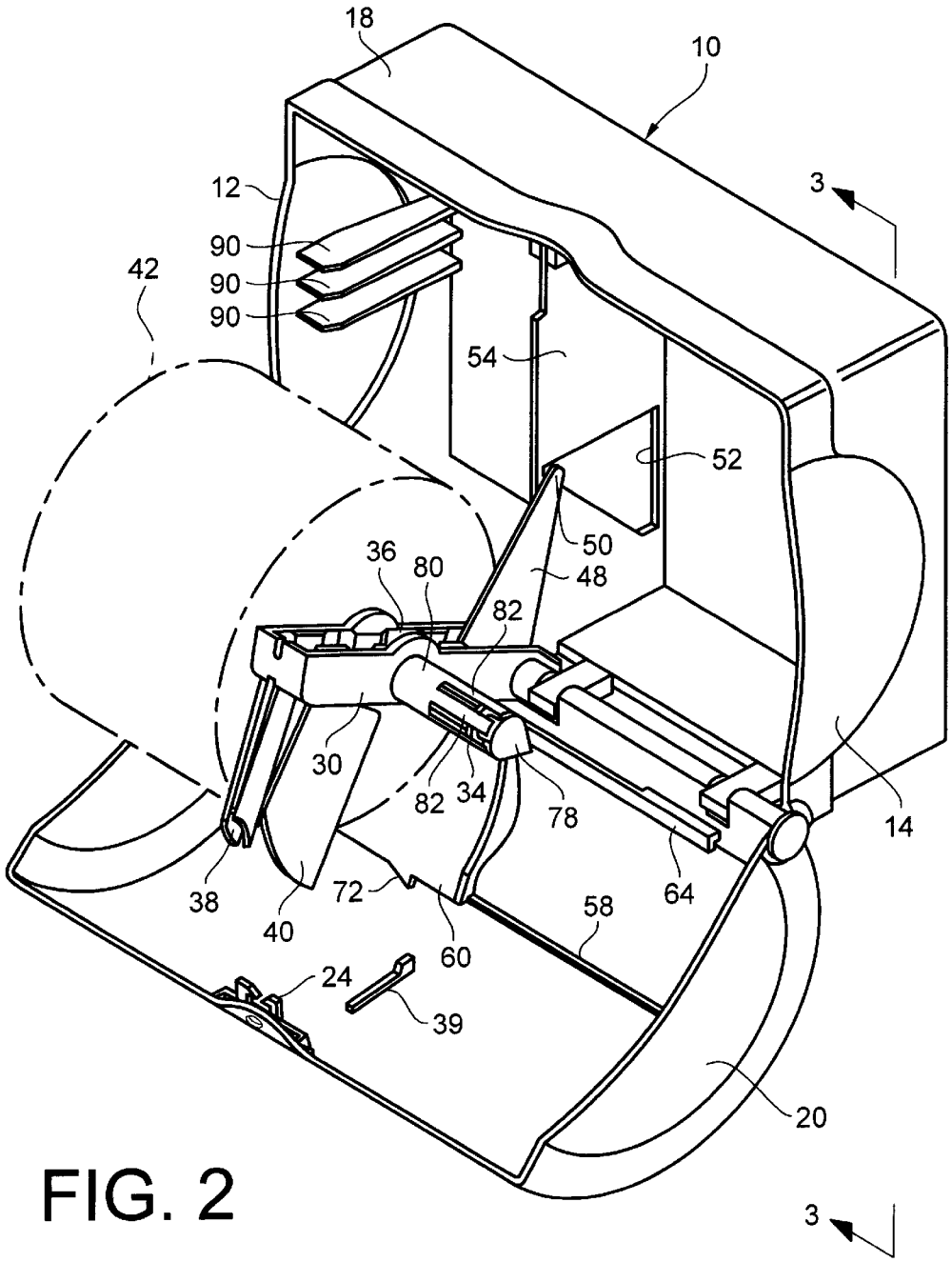
FIG. 2 is a perspective view of the apparatus showing the first and second housing members pivoted apart to disclose the interior mechanism of the apparatus including roll support means and locking means.
Figure 3:
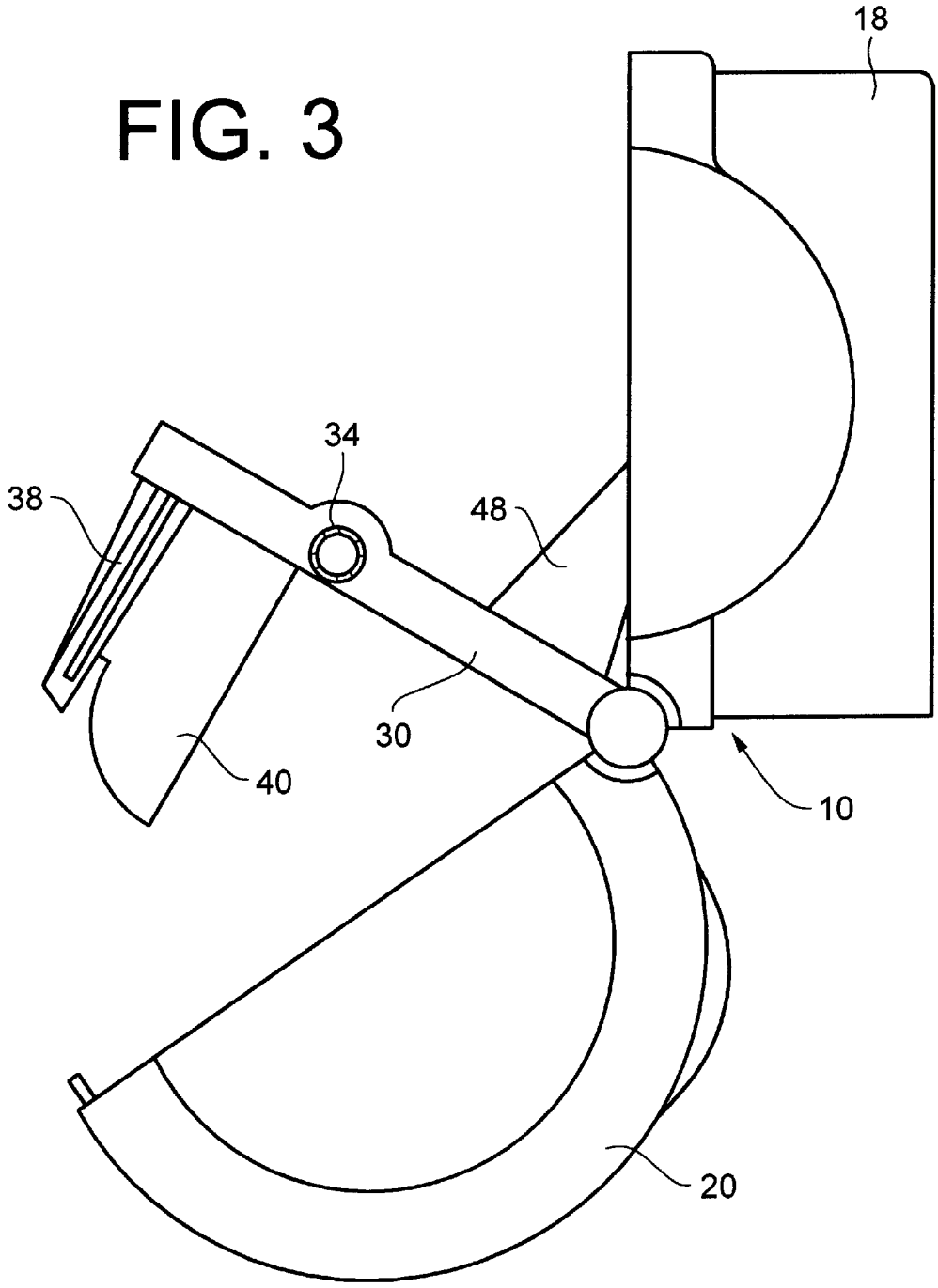
FIG. 3 is a simplified side view taken along the section line 3—3 in FIG. 2.
Figure 6A:
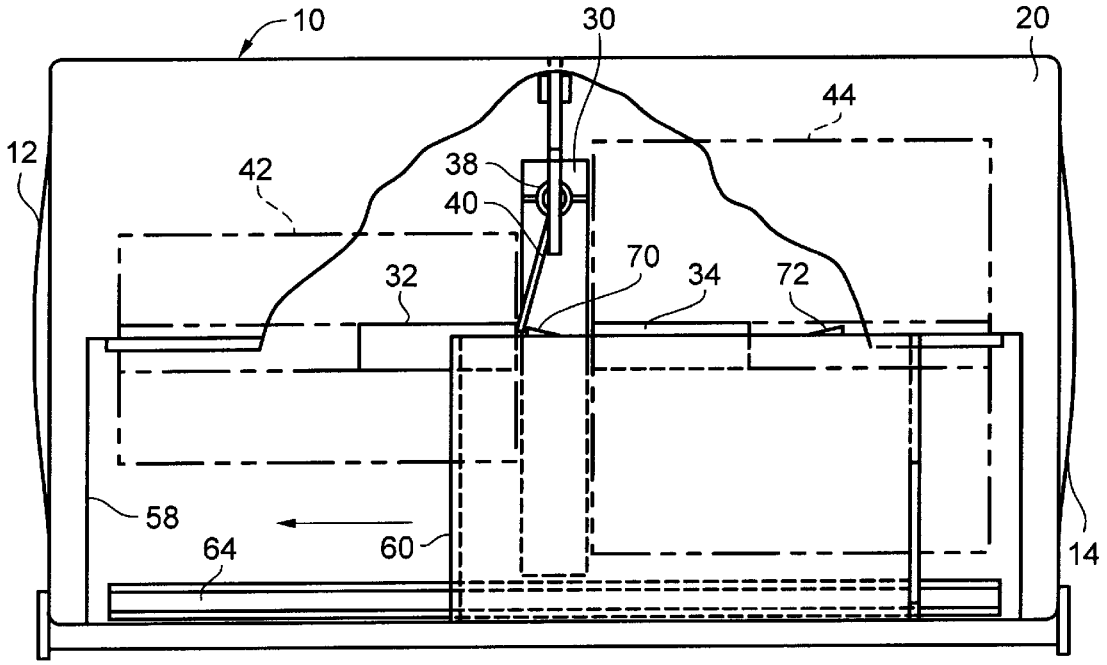
FIGS. 6A and 6B are front elevational views of the apparatus illustrating the respective positions assumed by selected structural elements thereof during different stages of operation of the apparatus.
Figure 6B:
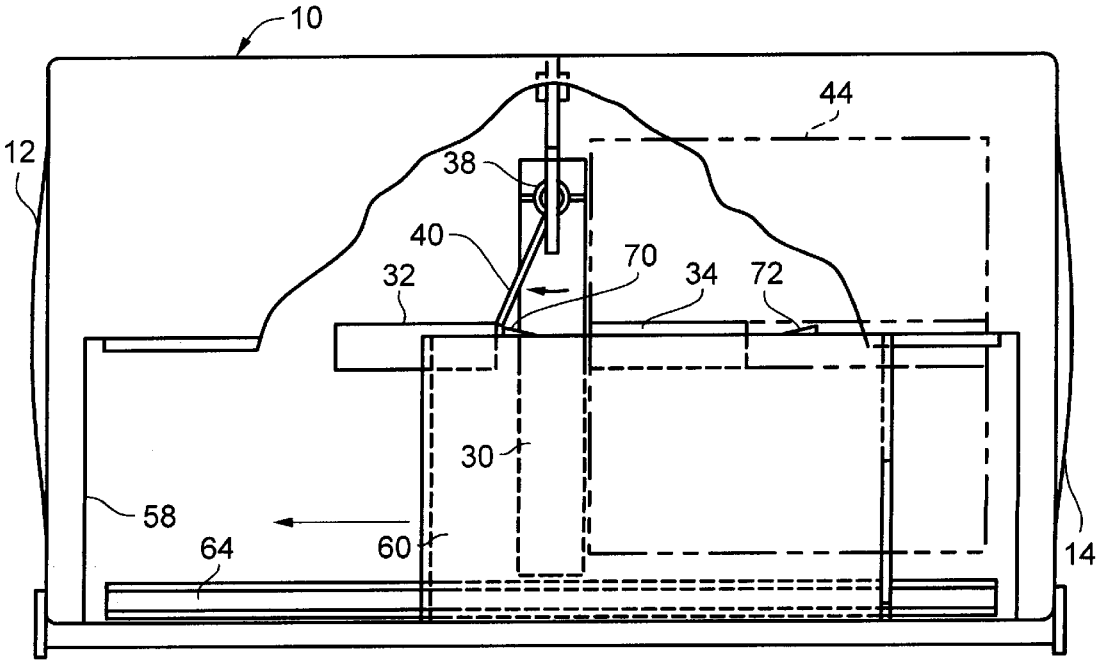

In FIGS. 2, 6 and 6A, the toilet tissue rolls that are mounted on the roll support spindles 32, 34 are illustrated in dash lines. One toilet tissue roll 44 is mounted on one of the roll support spindles 32 (FIGS. 2 and 6) and another toilet tissue roll 44 is mounted on the other roll support spindle 34 (FIGS. 6 and 6A).

Figure 5:
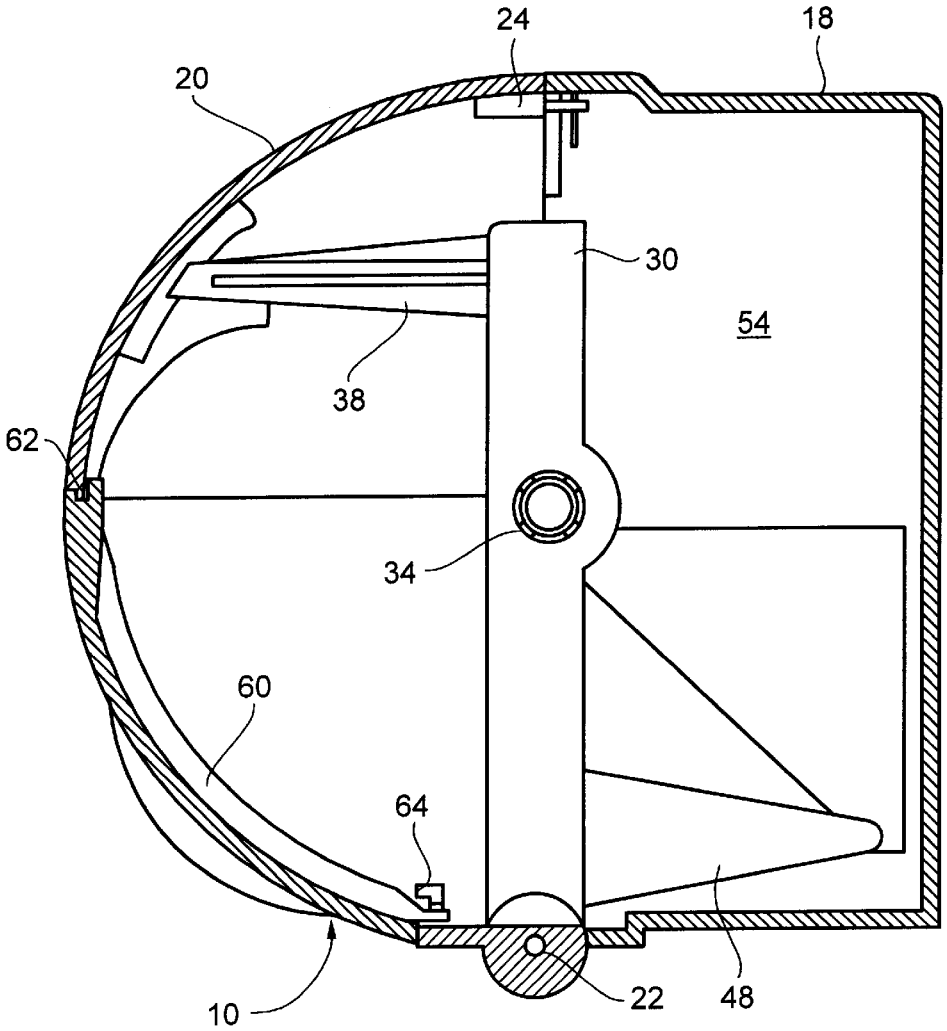
FIG. 5 is a cross-sectional view taken along the section line 5—5 of FIG. 4.

The roll support mechanism including the support frame 30 and the roll support spindles 32, 34 is pivotally movable between the positions shown in FIG. 2 and FIG. 5. That is, pivotal movement of the support frame 30 relative to the first housing member 18 causes the roll support spindles 32, 34 to move either toward or away from the first housing member. Of course, the roll support mechanism is in the position shown in FIG. 5 during dispensing operation of the dispenser and in the position shown in FIG. 2 when the front or second housing member 20 has been pivoted to an open position facilitating replenishment of toilet tissue rolls during servicing of the dispenser apparatus. Pivotal movement of the support frame 30 to limit the distance the roll support spindles 32, 34 may be moved away from the first housing member is limited by an extension 48 of the support frame 30 which has a distal end 50 projecting into the confines of an opening 52 formed in a stabilizer plate 54 projecting outwardly from the back wall of the first housing member 18.

An opening 36 in the support frame 30 receives the stabilizer plate 54 when the support frame is in the position shown in FIG. 5 to stabilize not only the support frame 30 but also the roll support spindles 32, 34 and the toilet tissue rolls supported on the roll support spindles 32, 34. The opening 36 is preferably dimensioned or restricted to provide engagement between the support frame 30 and the stabilizer plate 54 when the support frame has been pivoted upwardly into its dispensing position.

The front or second housing member 20 defines an opening 58 accommodating a cover 60 slidably movable within the opening 58 relative to the second housing member 20. The cover 60 is movable between a first cover location wherein a first roll of toilet tissue is exposed for manual access and a second roll of toilet tissue is not exposed for manual access (i.e., is covered) and a second cover location wherein the second roll of toilet tissue is exposed for manual access and a first roll of toilet tissue is not exposed for manual access (i.e., is covered). That is, through application of a manual force to the cover 60, the cover 60 may be slid relative to the second housing member 20 between the position shown in FIG. 1, for example, and that shown in FIG. 2, for example. At its upper edge, the cover 60 defines a slot 62 which receives the second housing member 20 where the second housing member defines opening 58. At its lower edge, the cover 60 is received within a slot defined by the second housing member and a longitudinally extending reinforcement member 64.

A locking mechanism is provided for locking the cover 60 against slidable movement relative to the second housing member between the first and second cover locations until substantial depletion of one of the rolls of toilet tissue. The above-described toilet tissue roll end engagement member 40 comprises one element of such locking mechanism. Another other constituent element of the locking mechanism are detents on the cover that are engageable with the tissue roll end engagement member.

More specifically, two spaced detents 70, 72 on the cover 60 are alternately engageable with the toilet tissue roll end engagement member. One of the detents 70 is cooperable with the toilet tissue roll end engagement member 40 to prevent sliding of the cover 60 in the direction of the end 12 of the housing and the other detent 72 is cooperable with the toilet tissue roll end engagement member 40 to prevent sliding of the cover 60 in the direction of the housing end 14. As will now be seen, the detents 70, 72 and the toilet tissue roll end engagement member 40 cooperate to lock the cover 60 against sliding movement only up to the point where the toilet tissue roll is substantially depleted on the respective spindle toward which the cover is being manually urged.

FIG. 6A shows one of the toilet tissue rolls 42 partially depleted and the other toilet tissue roll 44 comprising a full tissue roll. If a force is exerted on the cover 60 in the direction of the bold arrow shown in FIG. 6A, the movement of the cover 60 toward the opposite housing end 12 is prevented due to engagement of the detent 70 with the toilet tissue roll end engagement member 40 and the engagement of the toilet tissue roll end engagement member 40 with the end of the tissue roll 42. The engagement of the toilet tissue roll end engagement member 40 with the end of the tissue roll 42 prevents the toilet tissue roll end engagement member 40 from being pivoted to a position which would otherwise allow the detent 70 to move past the toilet tissue roll end engagement member 40.

The detents 70, 72 are triangular shaped and each includes a substantially straight abutment surface projecting orthogonally relative to the path of sliding movement of the cover and an inclined ramp surface leading from the abutment surface.

FIG. 6A illustrates the operation of the device after the toilet tissue roll 42 has been depleted. The depletion of the toilet tissue roll 42 allows the toilet tissue roll end engagement member 40 to be rotated or pivoted, as shown by the small bold arrow, about the projection 38 sufficiently by the detent 70 as a result of force applied by manually sliding the cover 60 in the direction of the large bold arrow such that the detent 70 clears (or passes under) the toilet tissue roll end engagement member 40, thus allowing the cover 60 to be slid completely to the opposite end 12 of the housing to thereby expose the other toilet tissue roll 44 for manual access through the opening 58. Of course, the direction of movement of the structural elements just described is reversed when the tissue roll 44 is depleted and the other tissue roll 42 is to be exposed.

Figure 4:
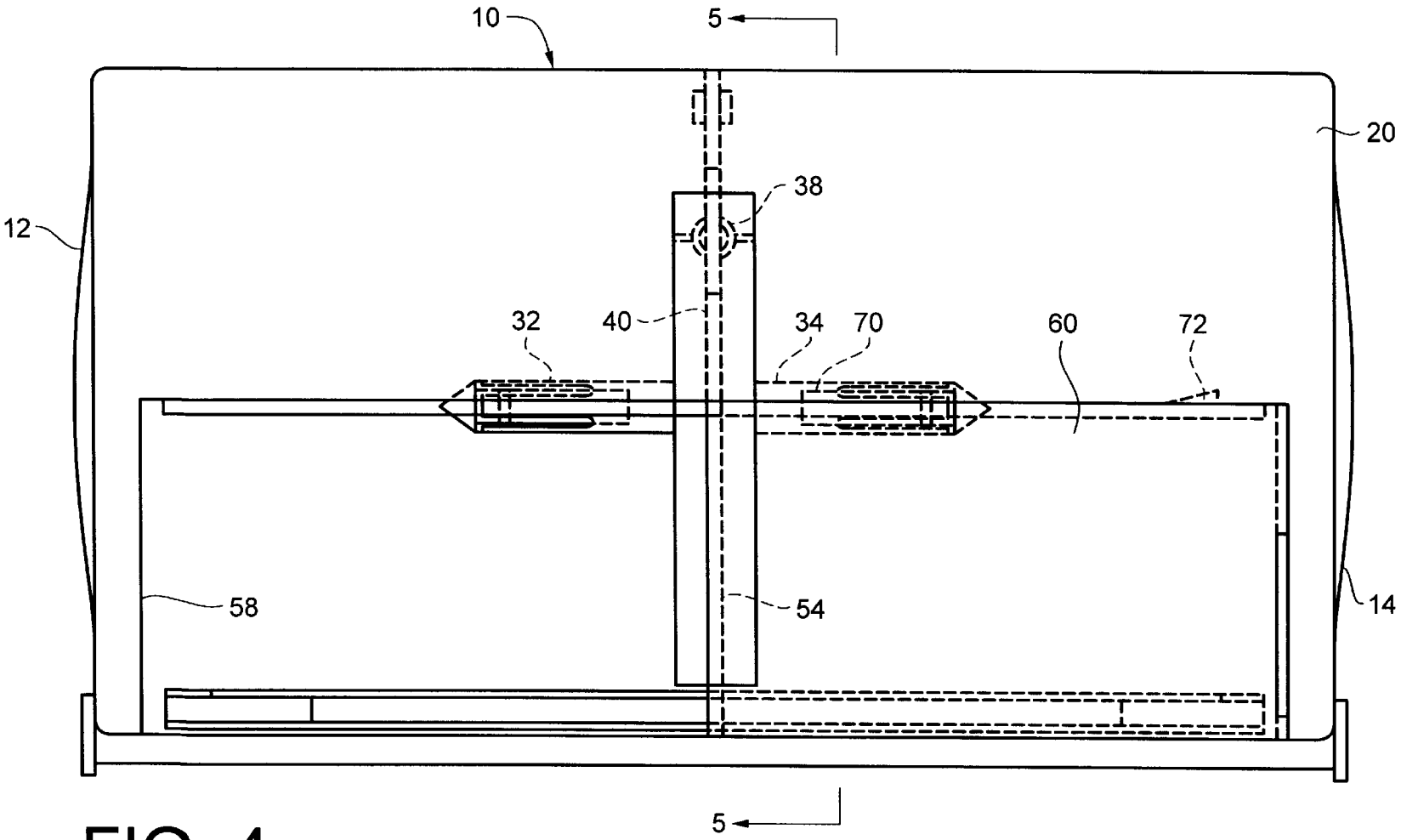
FIG. 4 is a front elevational view of the apparatus with the first and second housing members thereof secured together.

As shown in FIGS. 2 and 4, each of the roll support spindles 32, 34 includes a support shaft 78 and a sleeve 80 rotatably disposed about the support shaft 78 for insertion into a toilet tissue roll. As stated earlier, the roll support spindles 32, 34 may be utilized with coreless rolls of toilet tissue which typically have a small central opening. Each support shaft 78 is tapered at its outermost end to facilitate entry of the roll support spindle into the central opening of the coreless toilet tissue roll.

The sleeve 80 includes flexible elements or fingers 82 which are depressed inwardly upon insertion of the sleeve into a coreless toilet tissue roll so that there is frictional engagement between the flexible elements 82 of the sleeve 80 and the support shaft 78. This frictional engagement resists rotation of the sleeve 80 and the toilet tissue roll about the support shaft 78 so that the tissue roll will not "free-wheel" relative to the roll support spindle.

FIG. 2 discloses several tissue roll end engagement members in the form of ribs 90 which project inwardly from the ends of the housing into the housing interior. These ribs are observable in the FIG. 2 as projecting from one of the ends 12 of the housing, but it will be appreciated that similar ribs also project inwardly from the opposite housing end 14. The ribs 90 are engageable by the ends of the toilet tissue rolls on the roll support spindles to prevent end-wise removal of the toilet tissue rolls from the roll support spindles while the second housing member 20 is in the closed position.

Figure 7:
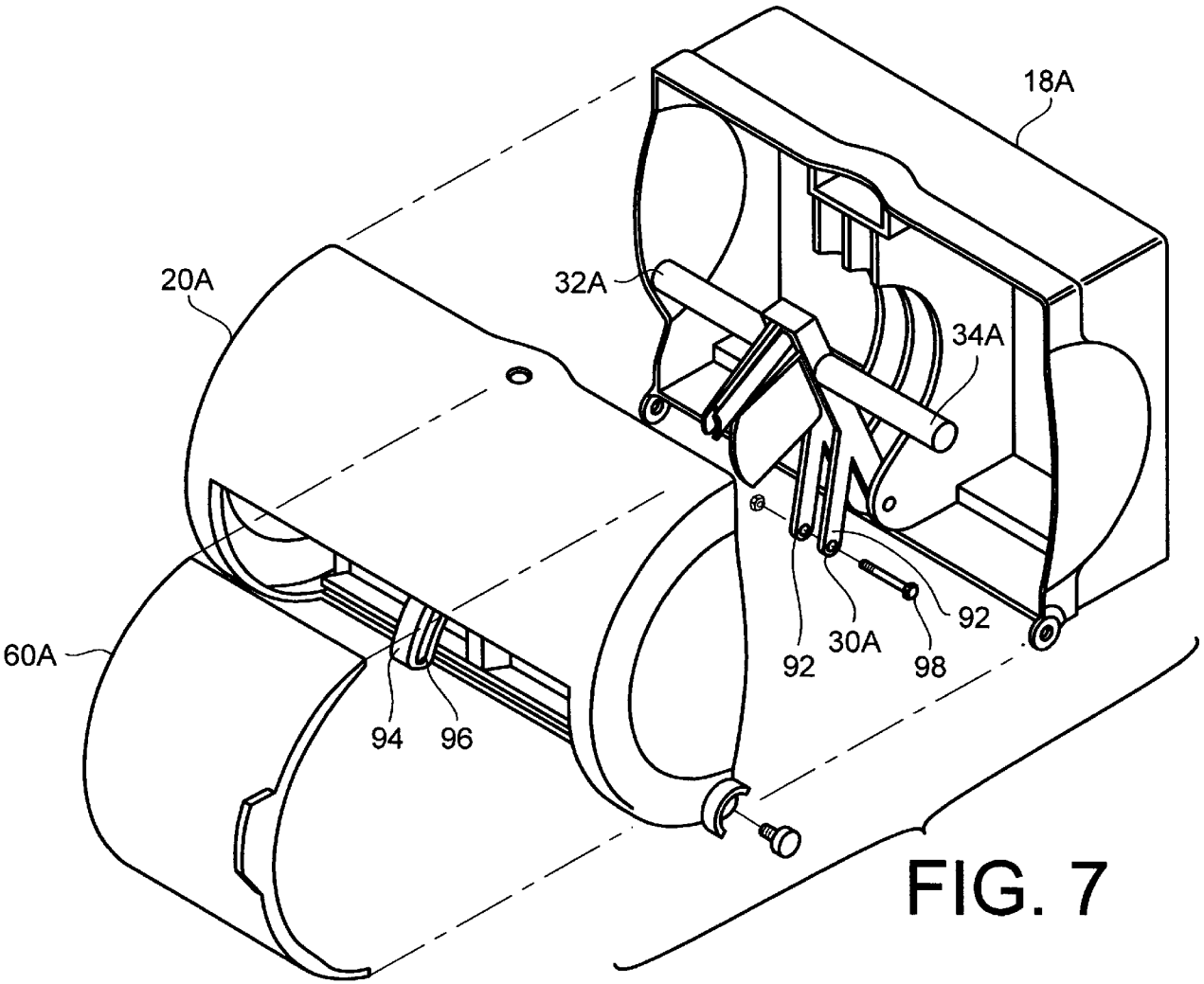
FIG. 7 is an exploded, perspective view of an alternate embodiment of the dispenser apparatus showing selected structural components thereof.
Figure 8:
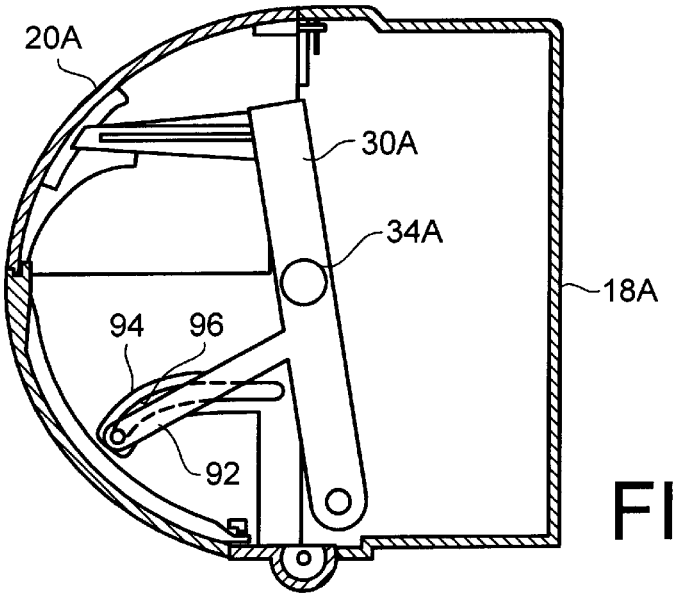
FIG. 8 is a cross-sectional, side view of the alternate embodiment of the apparatus and illustrating the first and second housing members thereof in closed condition.
Figure 9:
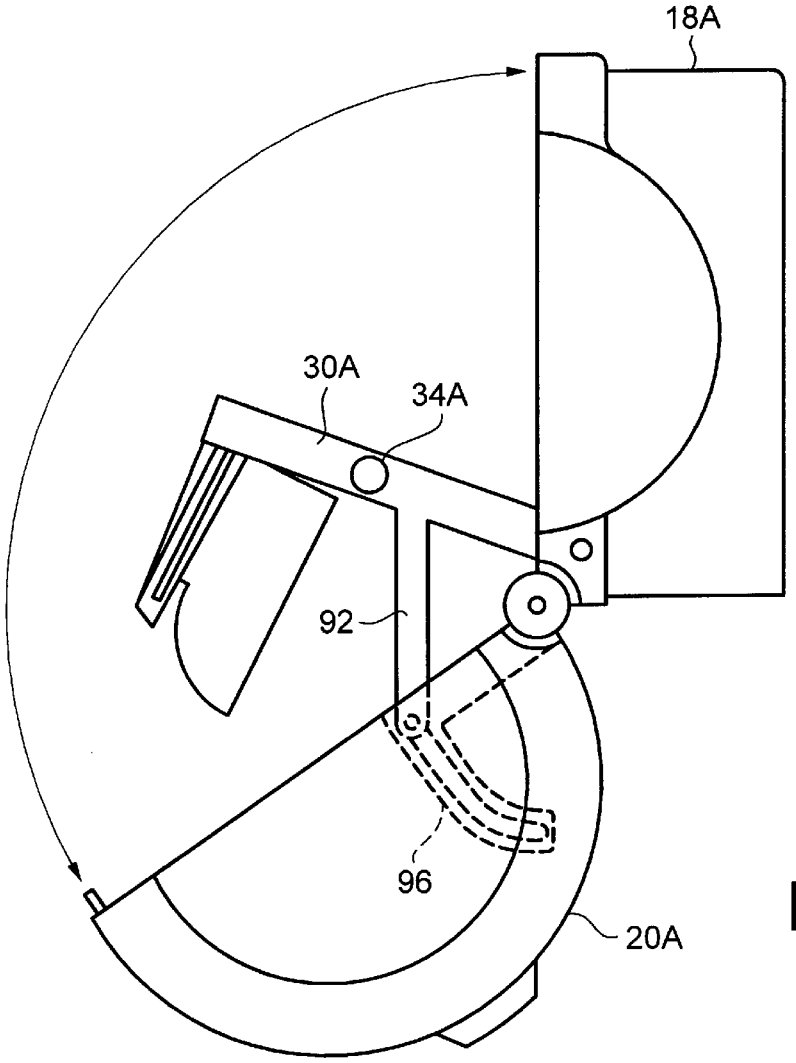
FIG. 9 is a side view of the embodiment of the invention shown in FIGS. 7 and 8, but illustrating the housing members pivoted open and the roll support structure placed in roll loading position.

FIGS. 7–9 illustrate an alternative embodiment of the apparatus including a first housing member 18A and a pivoted second housing member 20A. In this embodiment of the invention, the support frame 30A has a somewhat different configuration than the above-described support frame 30. For example, the support frame 30A includes two projecting members or legs 92. The illustrated roll support spindles 32A, 34A comprise opposed end segments of a unitary shaft affixed to the support frame 30A.

Attached to the second housing member 20A is an upwardly projecting connector element 94 defining a curved guideway or slot 96. Legs 92 are disposed on opposed sides of the connector element and a threaded connector 98 extends through holes at the ends of legs 92 and through curved slot 96. With this arrangement, the outward pivoting of the support frame 30A and roll support spindles 32A, 34A will automatically occur when the second housing member 20A is moved to its open position. FIG. 9 shows the second housing member 20A pivoted to the open position and FIG. 8 illustrates the first housing member 18A and second housing member 20A latched in the closed position. The closing of the second housing member automatically causes the support frame 30A to move to the position shown in FIG. 8. FIG. 7 also illustrates the cover 60A that is slidably mounted on the second housing member 20A.

Figure 13:
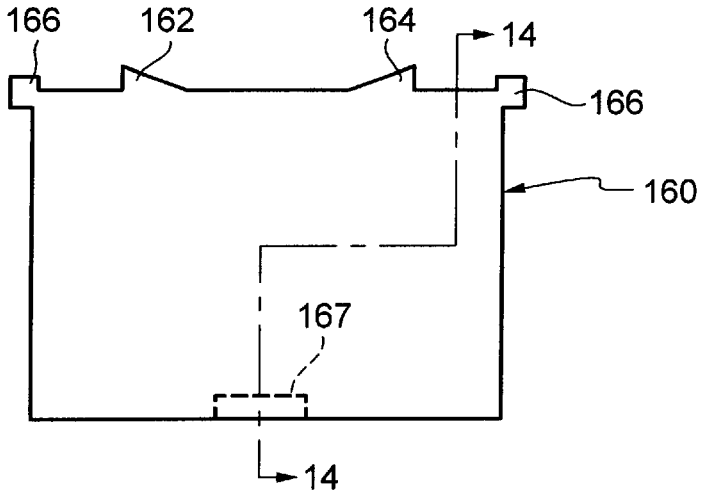
FIG. 13 is a front view of an alternative configuration for the slidable cover that can be used in the dispenser shown in FIGS. 1—9.
Figure 14:
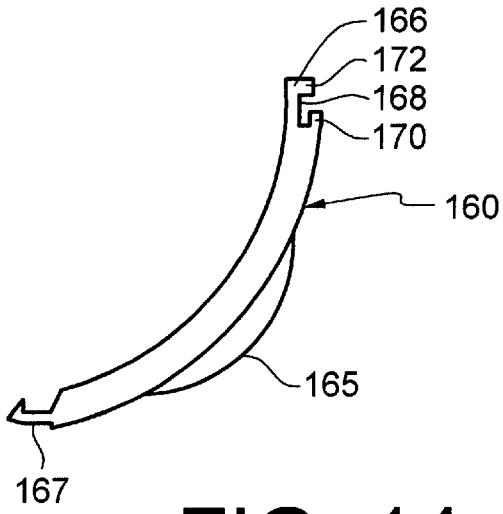
FIG. 14 is a cross-sectional view of the cover shown in FIG. 13 taken along the section line 14—14 in FIG. 13.
Figure 15:
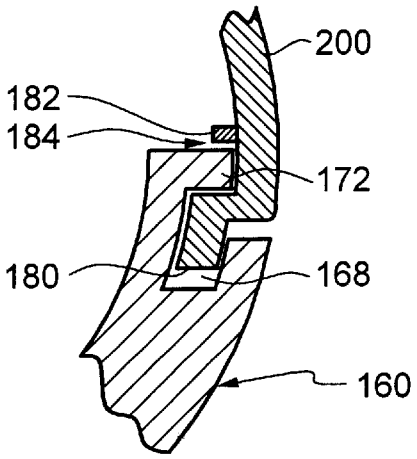
FIG. 15 is an enlarged cross-sectional view taken along the section line 15—15 in FIG. 16 illustrating the upper portion of the cover and the way in which the housing engaging members on the cover engage the second housing member.
Figure 16:
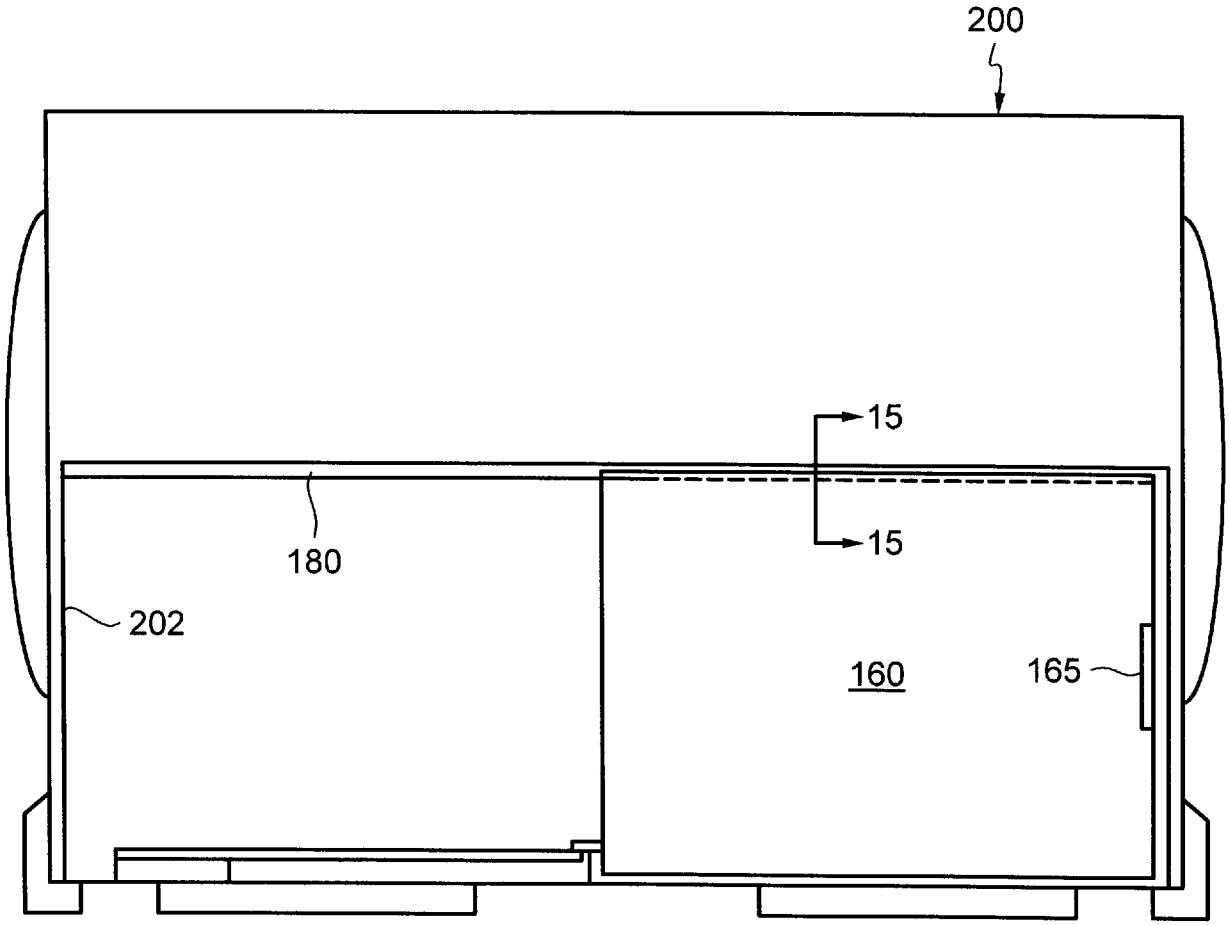
FIG. 16 is a front view of the second housing member with the slidable cover mounted in the opening in the second housing member.
Figure 17:
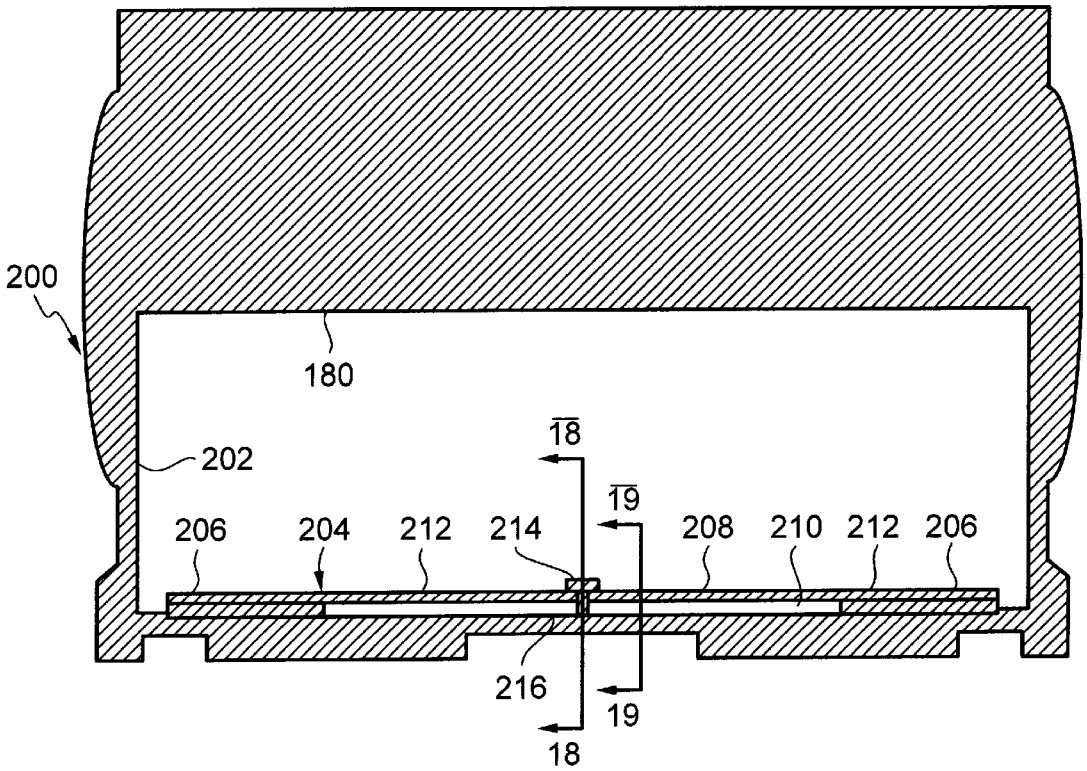
FIG. 17 is a front view of the second housing member shown in FIG. 16 prior to mounting the slidable cover in the opening in the second housing member.
Figure 18:
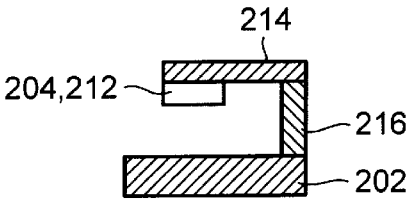
FIG. 18 is a cross-sectional view of the second housing member taken along the section line 18—18 in FIG. 17.
Figure 19:
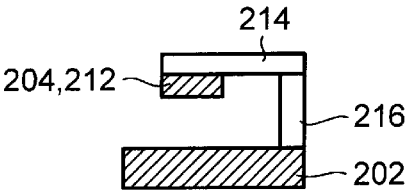
FIG. 19 is a cross-sectional view of the second housing member taken along the section line 19—19 in FIG. 17.

FIG. 16 illustrates an alternative configuration for the second housing forming a part of the housing of the dispenser and shows the cover according to an alternative configuration mounted on the second housing. FIGS. 13–14 illustrate details relating to the alternative configuration for the cover, and FIG. 15 illustrates the way in which the cover engages a portion of the second housing. FIGS. 17–19 show details pertaining to the alternative configuration for the second housing. The cover and the second housing shown in FIGS. 13–19 are adapted to be used in conjunction with the other features of the dispenser described above.

With reference to FIGS. 13 and 14, the cover 160 includes a pair of detents 162, 164 similar to the detents 70, 72 described above and adapted to engage the toilet tissue roll end engagement member. A handle 165 is provided on one end of the cover 160 to slide the cover between the first and second cover locations. A hook-like element 167 extends from the bottom of the cover 160 for engaging a portion of the second housing as will be described below in more detail.

The cover 160 also includes a pair of groove engaging members 166, 166 that are located at the upper side of the cover and at opposite ends of the cover. As shown in FIG. 14, the groove engaging members 166 each include an upstanding ridge 170 and a flange 172 located above the ridge 170. The flange 172 extends towards the outer surface of the cover 160. The flange 172 and the ridge 170 together define a slot 168 that opens towards the outside surface of the cover. The slot 168 is adapted to receive a portion of the second housing when the cover 160 is mounted on the second housing member.

As seen in FIG. 16, the second housing member 200 includes an opening 202 for providing access to the interior of the dispenser housing. The cover 160 is adapted to be mounted in the opening 202 in the second housing member 200 for sliding movement between the first and second cover locations as described above. A first rib 180 is provided at the inner side of the second housing member at a position bordering on the upper side of the opening 202. As seen in FIG. 15, a second rib 182 is secured to the inner side of the second housing member 200 at a position above the first rib 180. A groove 184 is thus defined in the inner side of the cover 160 between the first and second ribs 180, 182. The first and second ribs 180, 182 preferably extend along the entire extent or substantially the entire extent of the housing from one end of the housing to the opposite end of the housing.

As shown in FIG. 15, the flange 172 of each housing engaging member 166 is positioned in the groove 184 that is defined between the first and second ribs 180, 182. Also, the first rib 180 is received in the slot 168 formed in the upper side of the cover 160. This construction provides a strong connection of the cover to the second housing member that is able to withstand the significant forces encountered during repeated and forced sliding of the cover between the first and second cover locations.

FIGS. 17–19 illustrate features relating to the construction of the second housing member that provides a further strengthened mounting of the cover on the second housing member. As seen in FIG. 17, the second housing member 200 includes a reinforcing rib element 204 having opposite end portions 206, 206 that are secured to the second housing member along the portion of the second housing member 200 bordering on the lower side of the opening 202. The reinforcing rib element 204 also includes an intermediate portion 208 that is spaced from the lower side of the opening 202 to define a through slot 210. When the cover 160 is mounted on the second housing member 200 in the manner shown in FIG. 16, the hook-like element 167 extending from the lower side of the cover 160 as shown in FIG. 14 extends through the through slot 210 so that the upstanding lip on the hook-like element 167 engages the reinforcing rib element 204. This engagement of the hook-like element 167 with the reinforcing rib element 204 and the engagement of the housing engaging members 166 at the upper side of the cover 160 with the second housing member 200 as shown in FIG. 15 serves to mount the cover 160 on the second housing member 200 in a manner that allows the cover to be slidably moved between the first cover location and the second cover location.

As seen in FIG. 17, the reinforcing rib element 204 is comprised of a pair of reinforcing ribs 212 having adjacent ends that are spaced apart from one another. The adjacent ends of the reinforcing ribs 212 are connected by a first connecting piece 214 that is secured in the illustrated embodiment to the upper surfaces of the reinforcing ribs 212. A second connecting piece 216 connects the first connecting piece 214 to the portion of the second housing member 200 that borders the lower side of the opening 202 in the second housing member 200. Thus, by this construction, the reinforcing rib element 204 is connected to the second housing member 200 not only at its ends, but at a point intermediate its ends. This significantly increases the strength of the reinforcing rib element 204 because it reduces the length of the unconnected or unsupported portion of the reinforcing rib element 204. This is quite useful because as the cover 160 is repetitively slid back and forth along the opening 202 in the second housing member, typically with significant force, the hook-like element 167 on the cover 160 which engages the reinforcing rib element 204 can apply a pulling force to the reinforcing rib element 204. If the reinforcing rib element 204 is made of plastic material, for example, the force can result in excessive stress being applied to the reinforcing rib element 204. As the unsupported or unconnected length of the reinforcing rib element 204 increases, so too does the possibility of damaging or possibly even breaking the reinforcing rib element. Thus, by connecting the reinforcing rib element 204 to the second housing member at a point intermediate the fixed ends of the reinforcing rib element 204, the unsupported or unconnected length of the reinforcing rib element 204 is reduced and the ability of the reinforcing rib element 204 to withstand forces generated during sliding of the cover 160 is significantly increased, thus reducing the likelihood of damaging the reinforcing rib element 204.

Figure 10:
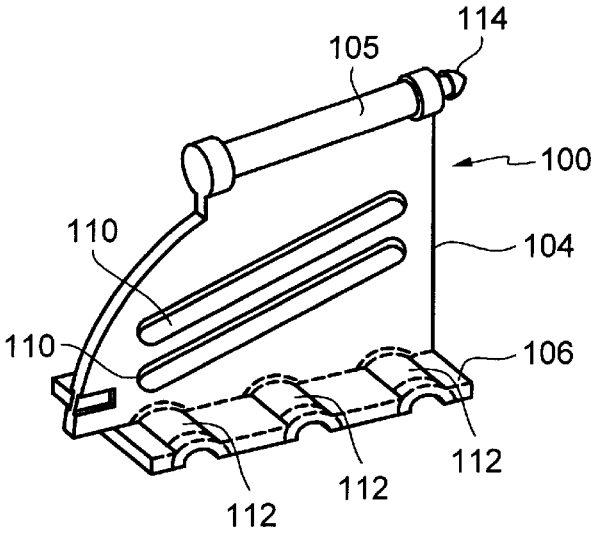
FIG. 10 is a perspective view of an alternative version of the toilet tissue roll end engagement member used in the dispenser shown in FIGS. 1—9.
Figure 11:
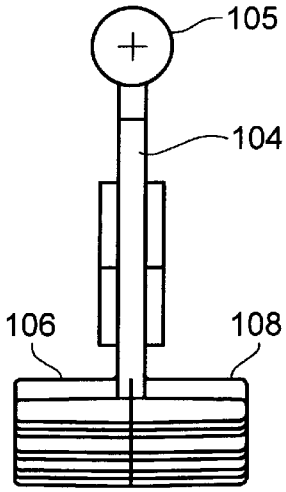
FIG. 11 is a rear view of the toilet tissue roll end engagement member depicted in FIG. 10.

FIGS. 10 and 11 illustrate another version of the toilet tissue roll end engagement member 100 forming a part of the dispenser of the present invention. The toilet tissue roll end engagement member 100 shown in FIGS. 10–12 can be used with the dispenser shown in FIGS. 1–9 and can be used with a dispenser having the alternative features shown in FIGS. 13–19. As can be seen from FIGS. 10 and 11, the toilet tissue roll end engagement member 100 includes a generally planar first leg 104 and a pair of second legs 106, 108. The second legs 106, 108 are positioned transverse (i.e., perpendicular) to the first leg 104 and extend away from the first leg 104. The first leg 104 is provided with several reinforcing ribs 110 that reinforce the first leg 104 and prevent the first leg 104 from bending during operation of the dispenser. Also, each of the second legs 106 is provided with curved regions 112 that impart rigidity to the second legs 106, 108. The upper portion of the first leg 104 of the toilet tissue roll end engagement member 100 is also provided with a pointed and tapering engagement element 114. The engagement element 114 is provided at the rear end of the upper portion 105 of the first leg 104 and is adapted to serve as a mounting mechanism for mounting the toilet tissue roll end engagement member 100 on the roll support mechanism 102 illustrated in FIG. 12. This roll support device 102 is similar to the roll support mechanism described above and illustrated in FIGS. 1–9.

The roll support mechanism 102 includes a support frame 116 from which extend a pair of roll support spindles 118, 120. Each of the roll support spindles 118, 120 is adapted to receive and support a respective toilet tissue roll. Each of the roll support spindles 118, 120 is configured in the same manner as the roll support spindles 32, 34 described above and includes a sleeve rotatably disposed about a support shaft, with the sleeve being comprised of flexible elements that are adapted to be pressed inwardly when the tissue roll is mounted on the spindle 118, 120 to frictionally engage the support shaft. As in the case of the roll support mechanism described above and illustrated in FIGS. 1–9, the roll support mechanism 102 is pivotally mounted on the first housing member by way of a pin that extends through a mounting portion 122 of the support frame 116.

The support frame 116 also includes a projection 124 defining an interior space 126 that is adapted to receive the upper portion 105 of the first leg 104 of the toilet tissue roll end engagement member 100 shown in FIGS. 10 and 11. The upper portion 105 of the of the first leg 104 of the toilet tissue roll end engagement member 100 is adapted to be slid into the interior space 126 of the projection 124 to mount the toilet tissue roll end engagement member 100 within the projection. The back wall of the projection 124 is provided with a small opening 128 that is adapted to receive the engaging element 114 extending from the rear upper portion 105 of the first leg 104 of the toilet tissue roll end engagement member 100. In this way, the toilet tissue roll end engagement member 100 is secured to the roll support device 102. Other features associated with the toilet tissue roll end engagement member 100 are the same as those described above and shown in FIGS. 1–9.

Figure 12:
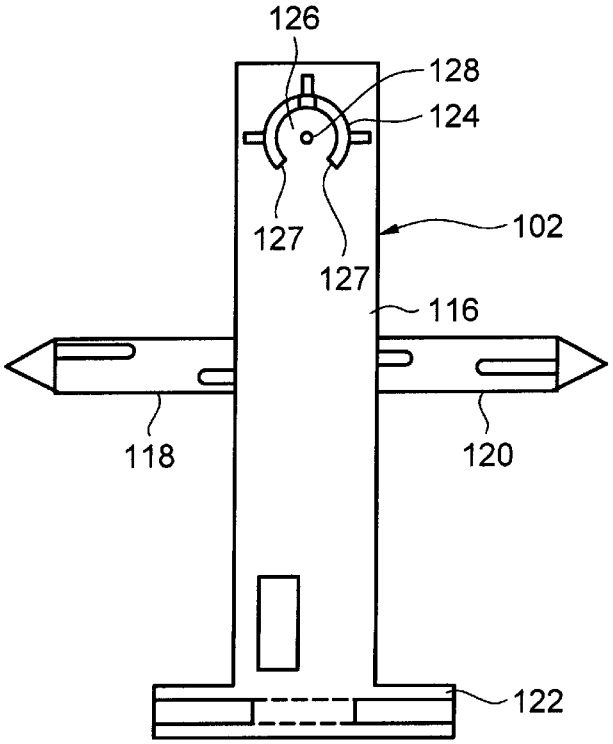
FIG. 12 is a front view of the roll support mechanism on which is mounted the toilet tissue roll end engagement member depicted in FIG. 10

As shown in FIG. 12, the projection 124 is open along a portion of its circumferential extent (i.e., the lower portion of the projection 124). This allows the toilet tissue roll end engagement member 100 mounted within the projection 124 to pivot along a predetermined arc on either side of a vertically oriented position. In the absence of tissue rolls, the toilet tissue roll end engagement member 100 is able to pivot to either side until it contacts one of the ends 127 of the projection 124.

The embodiment of the toilet tissue roll end engagement member 100 shown in FIGS. 10 and 11 is advantageous in providing a locking mechanism for the cover that is well suited to preventing the cover from being forced from one of the cover locations to the other until the toilet tissue on the uncovered tissue roll that is being dispensed (i.e., the exposed roll) is depleted or substantially depleted. As described above, the cover 60 shown in FIG. 1 and the cover 160 shown in FIGS. 13–16 are adapted to be slid between the first cover location and the second cover location. In the first cover location, the tissue roll on a first one of the roll support spindles 118, 120 is covered by the cover and the tissue roll on the second of the roll support spindles 118, 120 is uncovered. In the second cover location, the tissue roll on the second one of the roll support spindles 118, 120 is covered by the cover and the tissue roll on the first one of the roll support spindle 118, 120 is uncovered.

When the toilet tissue roll end engagement member 100 is used, for example, with a dispenser incorporating the cover 160 shown in FIGS. 12 and 13, as the cover 160 is slid between the first and second cover locations, the respective detent 162, 164 on the cover 160 engages the toilet tissue roll end engagement member 100 to cause the toilet tissue roll end engagement member 100 to pivot. If the tissue roll being dispensed is not depleted or substantially depleted, the toilet tissue roll end engagement member 100 will engage the end of the tissue roll being dispensed, thus preventing the toilet tissue roll end engagement member 100 from further pivoting to the extent necessary to allow the detent 162, 164 on the cover 160 to readily move past the toilet tissue roll end engagement member 100, thus locking the cover in its current cover location. On the other hand, if the tissue roll being dispensed is depleted or substantially depleted, the sliding movement of the cover 160 will cause the toilet tissue roll end engagement member 100 to pivot to a position which allows the detent 162, 164 on the cover 160 to move past the toilet tissue roll end engagement member 100, thereby allowing the cover to move from one cover location to the other cover location. Thus, with this construction, the cover locking mechanism's ability to effectively prevent the cover from being forcibly pushed from one cover location to the other cover location before the tissue roll being dispensed is depleted or substantially depleted depends at least in part on the toilet tissue roll end engagement member 100 being prevented from pivoting to such an extent that the detent 162, 164 on the cover is able to slide past the toilet tissue roll end engagement member 100. That is, the more the toilet tissue roll end engagement member 100 must pivot before engaging the end of the not yet depleted or substantially depleted tissue roll being dispensed, the easier it is to forcibly push the cover 160 so that the detent 162, 164 on the cover is able to move past the toilet tissue roll end engagement member 100.

The configuration of the toilet tissue roll end engagement member 100 shown in FIGS. 10 and 11 limits the amount by which the toilet tissue roll end engagement member 100 pivots before engaging the end of the not yet depleted or substantially depleted tissue roll being dispensed. This thus helps ensure that the cover 160 cannot be forcibly pushed to such an extent that the detent 162, 164 is able to move past the toilet tissue roll end engagement member 100 before the exposed tissue roll is depleted or substantially depleted. According to this aspect of the invention, if the cover 160 is forcibly slid from one of the cover locations to the other cover location when the tissue roll being emptied is not depleted or substantially depleted, the laterally extending second leg 106 or 108 contacts the end of the tissue roll being emptied. Because of the laterally extending nature of the second leg 106 or 108, the toilet tissue roll end engagement member 100 pivots only slightly before the laterally extending leg 106 or 108 contacts the end of the tissue roll being depleted. This means that it is much more difficult to forcibly push the cover past the toilet tissue roll end engagement member 100, thus providing an enhanced locking mechanism for the cover. Further, the reinforced nature of the first leg 104 and the second legs 106 of the toilet tissue roll end engagement member 100 helps resists bending of the first and second legs if the toilet tissue roll end engagement member 100 is pressed against the end of the not yet depleted tissue roll, thus also helping to prevent the cover from being forcibly pushed from one cover location to the other cover location before the tissue roll being dispensed is depleted or substantially depleted.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A dispenser for dispensing toilet tissue from rolls of toilet tissue, comprising:

a double-ended housing defining a housing interior and including a first housing member and a second housing member connected to said first housing member and movable relative to said first housing member between an open position for accessing the housing interior and a closed position;

roll support means including first and second roll support spindles for supporting first and second rolls of toilet tissue in a coaxial relationship, with the first roll of toilet tissue located adjacent to one of the ends of said housing, the second roll of toilet tissue located adjacent to the other of the ends of said housing, and adjacent ends of said rolls of toilet tissue defining a space therebetween, each of said roll support spindles including a support shaft and a sleeve rotatably disposed about said support shaft for insertion into a toilet tissue roll;

a cover slidably positioned on said second housing member and selectively slidably movable relative to said housing between a first cover location wherein said first roll of toilet tissue is exposed for manual access and said second roll of toilet tissue is not exposed for manual access and a second cover location wherein said second roll of toilet tissue is exposed for manual access and said first roll of toilet tissue is not exposed for manual access; and locking means for locking said cover against slidable movement relative to said second housing member between said first and second cover locations until substantial depletion of one of the rolls of toilet tissue which is exposed for being dispensed, said locking means including a toilet tissue roll end engagement member pivotally mounted on said roll support means at a location between said first and second roll support spindles, dependent from said roll support means, and positioned in the space defined by the adjacent ends of toilet tissue rolls supported by said roll support means, and detents on said cover which are engageable with said toilet tissue roll end engagement member.

2. The dispenser according to claim 1, wherein each of said detents is generally triangular-shaped and includes a substantially straight abutment surface projecting substantially orthogonally relative to a path of sliding movement of said cover and an inclined ramp surface leading from said substantially straight abutment surface.

3. The dispenser according to claim 1, wherein said roll support means includes a support frame pivotally connected to said first housing member, said roll support spindles projecting outwardly from said support frame in opposed directions, with pivotal movement of said support frame relative to said first housing member causing said roll support spindles to move either toward or away from said first housing member.

4. The dispenser according to claim 3, including means for limiting pivotal movement of said support frame to limit a distance by which said roll support spindles may be moved away from said first housing member.

5. The dispenser according to claim 3, wherein said support frame defines an opening, and including a projection projecting from said first housing member and entering said opening of said support frame when said support frame has moved toward said first housing member.

6. The dispenser according to claim 3, including connector means connecting said support frame to said second housing member.

7. The dispenser according to claim 1, wherein said second housing member defines an opening accommodating said cover, and including reinforcement means for reinforcing said second housing member at said opening and resisting removal of said cover from said second housing member.

8. The dispenser according to claim 1, wherein said toilet tissue roll end engagement member comprises a pivoted plate.

9. The dispenser according to claim 1, including roll end engagement ribs projecting inwardly from the ends of said housing into said housing interior for engagement by ends of toilet tissue rolls on said roll support spindles to prevent end-wise removal of said toilet tissue rolls from said roll support spindles while said second housing member is in a closed position.

10. The dispenser according to claim 1, wherein said sleeve of each roll support spindle includes a plurality of flexible elements that, upon insertion of said sleeve into said toilet tissue roll, are pressed inwardly by the toilet tissue roll into frictional engagement with said support shaft to resist rotation of said sleeve and said toilet tissue roll about said support shaft.

11. A dispenser for dispensing toilet tissue from rolls of toilet tissue, comprising:

a housing in which is defined a housing interior, the housing including a first housing member and a second housing member connected to said first housing member, said second housing member including and opening and being movable relative to said first housing member between an open position for accessing the housing interior and a closed position;

a support frame mounted within the housing interior;

first and second roll support spindles mounted on the support frame and extending in opposite directions from the support frame for supporting respective rolls of toilet tissue so that a space exists between facing ends of the rolls of toilet tissue;

a cover slidably mounted in the opening in the second housing member and selectively slidably movable relative to said second housing member between a first cover location in which the roll of toilet tissue supported on the first roll support spindle is exposed for manual access and the roll of toilet tissue supported on the second roll support spindle is covered to prevent manual access, and a second cover location in which the roll of toilet tissue supported on the second roll support spindle is exposed for manual access and the roll of toilet tissue supported on the first roll support spindle is covered to prevent manual access, said cover being provided with at least one detent; and a toilet tissue roll end engagement member pivotally mounted on and extending from said support frame to be positioned in the space between the facing ends of the toilet tissue rolls, said toilet tissue roll end engagement member including a first leg and a second leg, said second leg extending transversely from said first leg, said toilet tissue roll end engagement member being engaged by the detent on the cover when the cover is urged from the first cover location towards the second cover location, said second leg being adapted to engage the facing end of the tissue roll supported on the second roll support spindle when the cover is urged from the first cover location towards the second cover location prior to substantial depletion of the roll of toilet tissue supported on the second roll support spindle to thereby prevent the cover from being moved to the second cover location.

12. The dispenser according to claim 11, wherein said second leg extends from one side of the first leg, said toilet tissue roll end engagement member including a pair of second legs extending transversely from said first leg.

13. The dispenser according to claim 11, wherein an upper side of said cover is provided with a slot in which is positioned a portion of the second housing member.

14. The dispenser according to claim 11, including a reinforcing rib element secured to the second housing member at a location below the opening in the second housing member, the reinforcing rib element having ends that are secured to the second housing member and an intermediate portion that is spaced from the second housing member to define a through slot, said reinforcing rib element being fixed to the second housing member at a point along said intermediate portion, a lower side of said cover being provided with a projecting piece passing through said through slot.

15. A dispenser for dispensing toilet tissue from rolls of toilet tissue, comprising:

a housing in which is defined a housing interior, the housing including a first housing member adapted to be mounted on a support surface and a second housing member connected to said first housing member and movable relative to said first housing member between an open position for accessing the housing interior and a closed position, said second housing member being provided with an opening bounded by an upper edge, a lower edge and a pair of side edges, said second housing possessing an inner side facing towards the housing interior when the second housing member is in a closed position, the second housing member including a rib located at the inner side of the second housing member, said rib being positioned above the upper edge of the opening and extending between opposite ends of the second housing member;

a support frame mounted within the housing interior;

first and second roll support spindles mounted on the support frame and extending in opposite directions from the support frame for supporting respective rolls of toilet tissue;

a cover slidably mounted within said opening in said second housing member and selectively slidably movable relative to said second housing member between a first cover location in which the roll of toilet tissue supported on the first roll support spindle is exposed for manual access and the roll of toilet tissue supported on the second roll support spindle is covered to prevent manual access, and a second cover location in which the roll of toilet tissue supported on the second roll support spindle is exposed for manual access and the roll of toilet tissue supported on the first roll support spindle is covered to prevent manual access, said cover having an upper side and opposite ends, said cover including at least one housing engaging member located at the upper side of the cover, the at least one housing engaging member is provided with a slot that receives said rib on the inner side of the second housing member.

16. The dispenser according to claim 15, wherein said rib on the inner side of said second housing member extends from one end of said second housing member to an opposite end of said second housing member.

17. The dispenser according to claim 15, including a pair of housing engaging members provided at the upper side of the cover, said housing engaging members being located at opposite ends of the cover, said rib on the inner side of the second housing member being a first rib, and including a second rib provided on the inner side of the second housing member to define a groove between the said first and second ribs, each of said housing engaging members possessing a flange positioned in said groove.

18. The dispenser according to claim 15, wherein the cover includes a pair of detents, and including a toilet tissue roll end engagement member pivotally mounted on and extending from said support frame, said toilet tissue roll end engagement member including a first leg and a pair of second legs, said second legs extending transversely from said first leg, said toilet tissue roll end engagement member being engaged by one of the detents on the cover when the cover is urged from the first cover location towards the second cover location, said toilet tissue roll end engagement member being engaged by the other detent on the cover when the cover is urged from the second cover location towards said first cover location, one of the second legs being adapted to engage one end of the tissue roll supported on the second roll support spindle when the cover is urged from the first cover location towards the second cover location prior to substantial depletion of the roll of toilet tissue supported on the second roll support spindle to thereby prevent the cover from being moved to the second cover location.

19. A dispenser for dispensing toilet tissue from rolls of toilet tissue, comprising:

a housing in which is defined a housing interior, the housing including a first housing member adapted to be mounted on a support surface and a second housing member connected to said first housing member and movable relative to said first housing member between an open position for accessing the housing interior and a closed position, said second housing member being provided with an opening bounded by an upper edge, a lower edge and a pair of side edges, said second housing possessing an interior surface facing towards the housing interior when the second housing member is in a closed position, said second housing member including a reinforcement member having opposite ends fixed to the interior surface of the second housing member and an intermediate portion spaced from the interior surface of the second housing member to define a through slot located below the opening in the second housing member, said second housing member including a fixing element that fixes a part of the intermediate portion of the reinforcing member to the interior surface of the second housing member;

a support frame mounted within the housing interior;

first and second roll support spindles mounted on the support frame and extending in opposite directions from the support frame for supporting respective rolls of toilet tissue;

a cover slidably mounted within said opening in said second housing member and selectively slidably movable relative to said second housing member between a first cover location in which the roll of toilet tissue supported on the first roll support spindle is exposed for manual access and the roll of toilet tissue supported on the second roll support spindle is covered to prevent manual access, and a second cover location in which the roll of toilet tissue supported on the second roll support spindle is exposed for manual access and the roll of toilet tissue supported on the first roll support spindle is covered to prevent manual access, said cover having a lower side from which extends a projecting engaging element extending into said through slot.

20. The dispenser according to claim 19, wherein said projecting element is hook-shaped and extends through said through slot.

21. The dispenser according to claim 19, wherein an upper side of said cover is provided with a slot in which is positioned a portion of the second housing member.

22. The dispenser according to claim 19, wherein the cover includes a pair of detents, and including a toilet tissue roll end engagement member pivotally mounted on and extending from said support frame, said toilet tissue roll end engagement member including a first leg and a pair of second legs, said second legs extending transversely from said first leg, said toilet tissue roll end engagement member being engaged by one of the detents on the cover when the cover is urged from the first cover location towards the second cover location, said toilet tissue roll end engagement member being engaged by the other detent on the cover when the cover is urged from the second cover location towards said first cover location, one of the second legs being adapted to engage one end of the tissue roll supported on the second roll support spindle when the cover is urged from the first cover location towards the second cover location prior to substantial depletion of the roll of toilet tissue supported on the second roll support spindle to thereby prevent the cover from being moved to the second cover location.

* * * * *